US011774151B1

(12) United States Patent
Kolloju et al.

(10) Patent No.: US 11,774,151 B1
(45) Date of Patent: Oct. 3, 2023

(54) HEAT PUMP REVERSING VALVE FAULT DETECTION SYSTEM

(71) Applicant: Trane International Inc., Davidson, NC (US)

(72) Inventors: Shivakumar Kolloju, Tamil Nadu (IN); Ragunanthanan Mylsamy, Tamil Nadu (IN); Jonathan E. Thrift, Jacksonville, TX (US); Dominique Schaefer Pipps, Flint, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 193 days.

(21) Appl. No.: 17/216,310

(22) Filed: Mar. 29, 2021

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2313/0292* (2013.01); *F25B 2313/02741* (2013.01); *F25B 2313/0315* (2013.01)

(58) Field of Classification Search
CPC ..... F25B 49/02; F25B 13/00; F25B 2313/02741; F25B 2313/0315
See application file for complete search history.

(56) References Cited

U.S. PATENT DOCUMENTS 4,211,089 A * 7/1980 Mueller ..... F25B 13/00 62/131
4,301,660 A 11/1981 Mueller et al.
9,285,802 B2 3/2016 Arensmeier
9,638,436 B2 5/2017 Arensmeier et al.
10,371,395 B2 8/2019 Rite et al.
10,675,940 B2 6/2020 Peng et al.
10,712,036 B2 7/2020 Mowris et al.
10,782,040 B2 9/2020 Wacker
11,293,659 B2 4/2022 Brahme et al.
2005/0262857 A1 12/2005 Hrejsa et al.
2017/0356348 A1* 12/2017 Ribarov ..... F04D 27/023
2018/0031266 A1 2/2018 Atchison et al.
2020/0370804 A1 11/2020 Snider et al.
2021/0302040 A1* 9/2021 Brahme ..... F24F 11/86
2021/0302041 A1* 9/2021 Brahme ..... F25B 49/02

* cited by examiner

*Primary Examiner* — Henry T Crenshaw
(74) *Attorney, Agent, or Firm* — WOMBLE BOND DICKINSON (US) LLP

(57) ABSTRACT

Example embodiments of the present disclosure relate to a heat pump assembly including a system or method for detecting a fault in the heat pump. Some embodiments include a method for detecting a switch over valve fault where the heat pump includes a refrigerant cycle, a compressor, a metering device, a first heat exchanger, an second heat exchanger, a temperature sensor, and a switch over valve, and where the method includes operating the HVAC system in one either a heating mode or a cooling mode, monitoring a refrigerant temperature associated with the refrigerant cycle using the temperature sensor, monitoring an outdoor ambient air temperature, determining a temperature difference between the refrigerant temperature and the outdoor ambient temperature, determining whether the temperature difference is greater than a predetermined temperature difference threshold, and declaring a switch over valve fault when the temperature difference is greater than the predetermined temperature difference threshold.

18 Claims, 8 Drawing Sheets

HEAT PUMP REVERSING VALVE FAULT DETECTION SYSTEM

TECHNOLOGICAL FIELD

The present disclosure relates generally to an improved device and method for determining whether a fault is occurring in a heating, ventilating, and air conditioning (HVAC) system, potentially with the switch over valve.

BACKGROUND

Heat pumps are becoming increasing popular HVAC devices because of the efficiencies these devices offer, including, for example, energy savings, packaging size reductions, and other advantages. These HVAC systems require the use of two opposite refrigeration cycles, typically a heating mode cycle and a cooling mode cycle. To utilize the advantages these systems offer, the heating and cooling mode cycles often use some or all of the same components. Given the differences between these two cycles and the number of components involved, failures may occur throughout the system.

One failure that is particular to these types of HVAC systems occurs when an HVAC system fails to operate in the appropriate refrigeration cycle for a given demand or situation. For example, a heat pump may receive a call to heat a given space, but due to a fault in the system, the refrigeration cycle may flow in a cooling mode cycle. The opposite may also occur. These faults fail to satisfy a conditioning demand, and, if undetected, they may also result in damage to the internal components of the HVAC system.

There can be several causes for these failures, however, many current HVAC systems do not include any system or method for detecting these issues. More troubling is that current HVAC systems typically do not provide any assessment of the underlying cause(s). As a result, service technicians are often required to diagnose faults on site, which may lead to downtime and increased repair and/or operation costs. This is common even when the root cause is relatively minor. Moreover, existing HVAC systems fail to address or implement any corrective action after these types of faults have been detected.

BRIEF SUMMARY

The present disclosure addresses these deficiencies and provides a system for detecting a fault in the HVAC system, potentially a heat pump. In some embodiments, the fault detected relates to the switch over valve, and in some embodiments, the system and method take corrective action and/or publishes that the fault has occurred.

The present disclosure thus includes, without limitation, the following example embodiments.

Some example implementations provide a heat pump comprising: a compressor, a metering device, a first heat exchanger, and a second heat exchanger; a refrigerant cycle comprising a refrigerant fluid that circulates between the first heat exchanger and the second heat exchanger; a temperature sensor configured to provide a signal indicative of a refrigerant temperature associated with the refrigerant fluid; a switch over valve coupled to the refrigerant cycle configured to adjust the refrigerant fluid between the first heat exchanger and the second heat exchanger in the refrigerant cycle, wherein the switch over valve comprises a heating mode configuration that directs the refrigerant fluid in a heating mode cycle when the heat pump is operating in a heating mode, and a cooling mode configuration that directs the refrigerant fluid in a cooling mode cycle when the heat pump is operating in a cooling mode; and control circuitry, wherein the control circuitry is configured to: receive a call to operate the heat pump in the heating mode or the cooling mode; determine a refrigerant temperature input based on the signal from the temperature sensor; determine an outdoor ambient air temperature input indicative of an outdoor ambient air temperature; determine a temperature difference between the outdoor ambient air temperature input and the refrigerant temperature input; determine whether the temperature difference is greater than a predetermined temperature difference threshold; and declare a switch over valve fault when the temperature difference is greater than the predetermined temperature difference threshold.

In some example implementations of the heat pump of any example implementation, or any combination of any preceding example implementation, the switch over valve fault comprises an indication that the switch over valve is in one of either the heating mode configuration when the heat pump receives the cooling mode call or the cooling mode configuration when the heat pump receives the heating mode call.

In some example implementations of the heat pump of any example implementation, or any combination of any preceding example implementation, the control circuitry is further configured to: first de-energize the switch over valve in response to declaring the switch over valve fault; and then re-energize the switch over valve.

In some example implementations of the heat pump of any example implementation, or any combination of any preceding example implementation, the control circuitry is located in a system controller and comprises a controller area network (CAN) communication network.

In some example implementations of the heat pump of any example implementation, or any combination of any preceding example implementation, the heat pump further comprising two or more metering devices, wherein a first metering device is located proximate the first heat exchanger and the temperature sensor is located between the first heat exchanger and the first metering device.

In some example implementations of the heat pump of any example implementation, or any combination of any preceding example implementation, the predetermined temperature difference threshold has a first value when the HVAC system receives the heating mode call and a second value when the HVAC system receives the cooling mode call, wherein the first value is less than the second value.

In some example implementations of the heat pump of any example implementation, or any combination of any preceding example implementation, the control circuitry is further configured to: determine if the HVAC device is in a defrost state when the heating mode call is received; and declare the switch over valve fault after determining the HVAC device is not in a defrost state.

In some example implementations of the heat pump of any example implementation, or any combination of any preceding example implementation, the control circuitry is further configured to: measure a time period that starts when the temperature difference is determined to be greater than the predetermined temperature difference threshold; and declare the switch over valve fault after the measured time period exceeds a predetermined time period.

In some example implementations of the heat pump of any example implementation, or any combination of any preceding example implementation, the control circuitry is further configured to: restart the time period if the temperature difference is determined to be less than a restart predetermined temperature difference threshold, wherein the restart predetermined temperature difference threshold is less than the predetermined temperature difference threshold.

In some example implementations of the heat pump of any example implementation, or any combination of any preceding example implementation, the control circuitry is further configured to: measure a temperature of a conditioned space; determine whether the temperature of the conditioned space is deviating from a temperature set point; and declare the switch over valve fault if the temperature of the conditioned space is deviating from the temperature set point and the temperature difference is greater than the predetermined temperature difference threshold.

Some example implementations provide a method of detecting a switch over valve fault in a heat pump, the method comprising: receiving a call to operate the heat pump in one of either a heating mode or a cooling mode; monitoring a refrigerant temperature associated with a refrigerant cycle of the heat pump using a temperature sensor; monitoring an outdoor ambient air temperature; determining a temperature difference between the refrigerant temperature and the outdoor ambient temperature; determining whether the temperature difference is greater than a predetermined temperature difference threshold; and declaring the switch over valve fault of a switch over valve of the heat pump when the temperature difference is greater than the predetermined temperature difference threshold.

In some example implementations of the method of any example implementation, or any combination of any preceding example implementation, the method further comprising: first de-energizing the switch over valve in response to declaring the switch over valve fault; and then re-energizing the switch over valve.

In some example implementations of the method of any example implementation, or any combination of any preceding example implementation, the method further comprising: measuring a time period that starts when the temperature difference is determined to be greater than the predetermined temperature difference threshold; and declaring the switch over valve fault after the measured time period exceeds a predetermined time period.

In some example implementations of the method of any example implementation, or any combination of any preceding example implementation, the predetermined temperature has a first value when the heat pump receives the heating mode call and a second value when the heat pump receives the cooling mode call, wherein the first value is less than the second value.

In some example implementations of the method of any example implementation, or any combination of any preceding example implementation, the method for determining the temperature difference when the heating call is received further comprises subtracting the outdoor ambient air temperature from the refrigerant temperature, and wherein the predetermined temperature difference threshold is approximately 0° F.

In some example implementations of the method of any example implementation, or any combination of any preceding example implementation, the method for determining the temperature difference when the cooling call is received comprises subtracting the refrigerant temperature from the outdoor ambient air temperature, and wherein the predetermined temperature difference threshold is approximately 7° F.

In some example implementations of the method of any example implementation, or any combination of any preceding example implementation, the refrigerant temperature is indicative of a temperature of the refrigerant cycle when a refrigerant of the heat pump is in either a liquid state or a mixed fluid state that is predominately liquid.

In some example implementations of the method of any example implementation, or any combination of any preceding example implementation, the refrigerant temperature is indicative of a temperature of the refrigerant cycle between an outdoor ambient air heat exchanger and an outdoor ambient air metering device.

In some example implementations of the method of any example implementation, or any combination of any preceding example implementation, the method further comprising: measuring a temperature of a conditioned space; determining whether the temperature of the conditioned space is deviating from a temperature set point; and declaring the switch over valve fault if the temperature of the conditioned space is deviating from the temperature set point and the temperature difference is greater than the predetermined temperature difference threshold.

In some example implementations of the method of any example implementation, or any combination of any preceding example implementation, the method further comprising transmitting an alert indicating the switch over valve fault has occurred to a remote device.

These and other features, aspects, and advantages of the disclosure will be apparent from a reading of the following detailed description together with the accompanying drawings, which are briefly described below. The disclosure includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed disclosure, in any of its various aspects and embodiments, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

DETAILED DESCRIPTION

Figure 1:
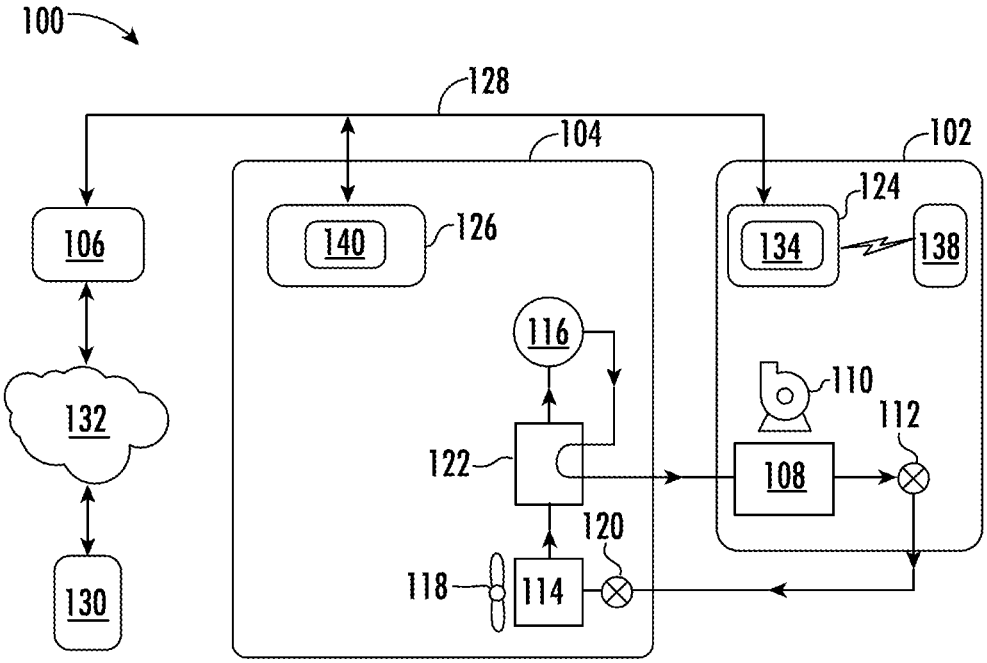
FIG. 1 is a schematic of an HVAC system, according to an example embodiment of the present disclosure.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments of the described disclosure in the installed configuration (e.g., in an operational configuration). It is understood that such terms are not used in any absolute sense.

Example embodiments of the present disclosure relate generally to an improved system and method for detecting a fault in a HVAC device, potentially a heat pump. In some embodiments, the fault detected relates to the switch over valve, and in some embodiments, the system and method take corrective action and/or publish that the fault has occurred. Example embodiments will primarily be described in conjunction with a switch over valve used for the refrigerant cycle within a heat pump device (either in split system or package unit configuration), but it should be understood that example embodiments may be utilized in conjunction with a variety of other applications. For example, other HVAC devices and/or fluid flows may utilize the system and method disclosed herein, including water-cooled HVAC systems, rooftop units, etc., as well as other devices generally, including water heaters, kitchen appliances, and the like. Furthermore, it should be understood that unless otherwise specified, the terms "data," "content," "digital content," "information," and similar terms may be at times used interchangeably.

Example embodiments of the present disclosure relate to an HVAC device that includes a refrigerant cycle where a refrigerant fluid is circulated by a compressor. This refrigerant cycle circulates between a heat providing heat exchanger that directs heat into the refrigerant cycle, and a heat discharging heat exchanger that directs heat out of the refrigerant cycle. In some embodiments, at least one metering device, potentially an expansion valve, is also included to adjust the pressure of the refrigerant fluid within the refrigerant cycle. These embodiments may further include a switch over valve, which may be referred to as a reversing valve, which may vary the flow of the refrigerant fluid within the refrigerant cycle between the heat exchangers and/or other components coupled to the refrigerant cycle.

The disclosed system and/or method for controlling this HVAC device utilizes temperature inputs for determining whether a fault has occurred in the HVAC device. In some embodiments, the system declares that a fault has occurred in the switch over valve. The fault may be detected by monitoring the temperature associated with the refrigerant fluid in the refrigerant cycle and the outdoor air temperature. The system may identify that a fault has occurred if the difference between these temperatures deviates beyond a predetermined temperature difference threshold. In some embodiments, the system takes corrective action to address the underlying cause of the fault. Some embodiments also include publishing and/or transmitting an alert indicating that a fault has occurred.

In one example embodiment, the HVAC device utilizing the disclosed system and method is a heat pump. Below is an overview of the system and method used to detect a fault in a heat pump system. Further details regarding the heat pump, and the system and method are discussed after this overview.

In some embodiments, the heat pump is in a split-system configuration and includes an outdoor unit and an indoor unit. In some embodiments, the heat pump system is in a packaged unit configuration where the components described below for the indoor unit and outdoor unit are located within a single unit that may be located inside or outside. The outdoor unit may include a compressor and an outdoor heat exchanger, potentially a first heat exchanger. The indoor unit may include a metering device such as an expansion valve and an indoor heat exchanger, potentially a second heat exchanger. Some embodiments may also include a refrigerant cycle that circulates a refrigerant fluid between the first and second heat exchangers. In some embodiments, the refrigerant cycle includes at least two different refrigerant cycles, potentially a heating mode cycle and a cooling mode cycle. Some embodiments may include a switch over valve that directs the refrigerant fluid in the refrigerant cycle in either the heating mode cycle or the cooling mode cycle.

In some embodiments, the heat pump includes the switch over valve coupled to the refrigerant cycle. The switch over valve (sometimes referred to as a reversing valve) serves to direct the refrigerant flow in the refrigerant cycle in the appropriate manner, e.g. the heating mode cycle when the heat pump is operating in a heating mode and the cooling mode cycle when the heat pump is operating in a cooling mode.

In some embodiments, one or more temperature sensors are used to measure various different aspects of the device as well as components and/or fluids associated with the device. In some embodiments, temperature sensors monitor the temperature associated with the refrigerant fluid at various different points within the refrigerant cycle. Some embodiments include one or more temperature sensors monitoring the outdoor ambient air temperature. Some embodiments are coupled to other auxiliary devices that provide the outdoor ambient air temperature and/or an indication of the outdoor ambient air temperature.

In some embodiments, control circuitry detects whether a switch over valve fault occurred within the HVAC device. In some examples, the fault relates to the switch over valve configuration and/or manner in which the refrigerant fluid flows through the refrigerant cycle. For example, the switch over valve fault may occur when the switch over valve directs the refrigerant fluid in the heating mode cycle when the HVAC device receives a call to operate in a cooling mode. The switch over valve fault may also occur when the switch over valve directs the refrigerant fluid to flow in the cooling mode cycle when the HVAC device receives a call to operate in a heating mode.

The control circuit determines a fault has occurred in the HVAC device using various methods and inputs. In some embodiments, the control circuitry determines this fault based on various temperature inputs and predetermined threshold values. In some embodiments, the control circuitry receives an indication to operate the HVAC device, potentially a heat pump, in either a heating mode or a cooling mode, potentially via a heating or cooling call. The control circuitry receives an indication of a temperature associated with the refrigeration fluid within the refrigerant cycle. This indication may be provided in a variety of ways as discussed more below. The control circuitry may determine a refrigerant temperature input based on the temperature information it receives, potentially from a temperature sensor, and the refrigerant temperature input may be indicative of the temperature of the refrigerant fluid. Control circuitry may also receive an indication of the temperature of the outdoor ambient air, which also may be provided in a variety of different ways as discussed in more detail below. The control circuitry may determine an outdoor ambient air temperature input based on the outdoor ambient air temperature information it receives, potentially from a temperature sensor, and the outdoor ambient air temperature input may be indicative of the temperature of the outdoor ambient air. In some embodiments, the control circuitry determines the difference between the refrigerant fluid temperature and the outdoor ambient air temperature, potentially using the refrigerant temperature input and the outdoor ambient air temperature input. In some embodiments, the control circuitry determines whether this temperature difference is above a predetermined temperature difference threshold, which may indicate a fault exists within the HVAC device. In some embodiments, the predetermined temperature difference is different when the HVAC device is operating in a heating mode than when the HVAC device is operating in a cooling mode. In some embodiments, the control circuitry declares a fault when the temperature difference is greater than the predetermined temperature threshold. In some embodiments, the fault relates to a switch over valve fault, and in some embodiments, this fault indicates that the switch over valve is circulating the refrigerant fluid in a heating mode cycle when the HVAC device received a call to operate in a cooling mode, e.g., a cooling mode call, or this fault indicates that the switch over valve is circulating refrigerant fluid in the cooling mode cycle when the HVAC device received a call to be operate in a heating mode, e.g., a heating mode call. In some embodiments, the control circuitry includes a timer. This timer may provide an indication of how long the temperature difference between refrigerant fluid temperature and ambient air temperature exceeds the predetermined threshold. In some embodiments, the control circuitry declares a fault only after the temperature difference exceeds the predetermined threshold after a set period of time, e.g., the timer expires. In some embodiments, the control circuitry publishes this fault, potentially by publishing an alert, indicating a fault has occurred. In some embodiments, the control circuitry takes corrective action, which in some embodiments includes energizing and reenergizing the switch over valve.

Referring now to FIG. 1, the features and steps will be discussed in more detail. FIG. 1 shows a schematic diagram of a typical HVAC system 100. Most generally, HVAC system 100 comprises a heat pump system that may be selectively operated to implement one or more substantially closed thermodynamic refrigerant cycles to provide a cooling functionality (hereinafter a "cooling mode cycle") and/or a heating functionality (hereinafter a "heating mode cycle"). The embodiment depicted in FIG. 1 is configured in a heating mode cycle. The HVAC system 100, configured as a split system heat pump system, generally comprises an indoor unit 102, an outdoor unit 104, and a system controller 106 that may generally control operation of the indoor unit 102 and/or the outdoor unit 104. The heat pump system may also comprise a packaged unit where the components described below for the indoor unit and outdoor unit are located within a single unit that may be located inside or outside.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between a refrigerant fluid carried within internal tubing of the indoor heat exchanger 108 and an airflow that may contact the indoor heat exchanger 108 but that is segregated from the refrigerant fluid. In some embodiments, including some packaged unit embodiments, the indoor heat exchanger may be referred to as a conditioned air heat exchanger, the indoor fan may be referred to as the conditioned air fan, the indoor metering device may be referred to as the conditioned air metering device, and the indoor system controller may be referred to as the conditioned air system controller. In these embodiments these components are located in the same position in the thermodynamic cycle as described in the embodiments disclosed with respect to the components of the indoor unit.

The indoor metering device 112 may generally comprise an electronically-controlled motor-driven EEV. In some embodiments, however, the indoor metering device 112 may comprise a thermostatic expansion valve, a capillary tube assembly, and/or any other suitable metering device. In some embodiments, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a switch over valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but is segregated from the refrigerant. In some embodiments, including some packaged unit embodiments, the outdoor heat exchanger may be referred to as an outdoor ambient air heat exchanger, the indoor fan may be referred to as the outdoor ambient air fan, the indoor metering device may be referred to as the outdoor ambient air metering device, and the indoor system controller may be referred to as the outdoor ambient air system controller. In these embodiments these components are located in the same position in the thermodynamic cycle as described in the embodiments disclosed with respect to the components of the outdoor unit.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

Figure 4A:
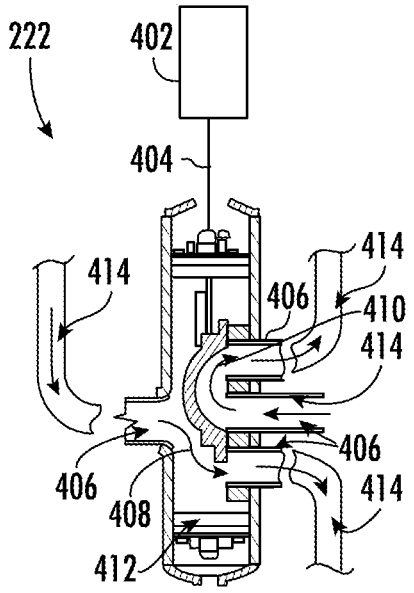
FIG. 4A is a cross-section illustration of a switch over valve, according to an example embodiment of the present disclosure.
Figure 4B:
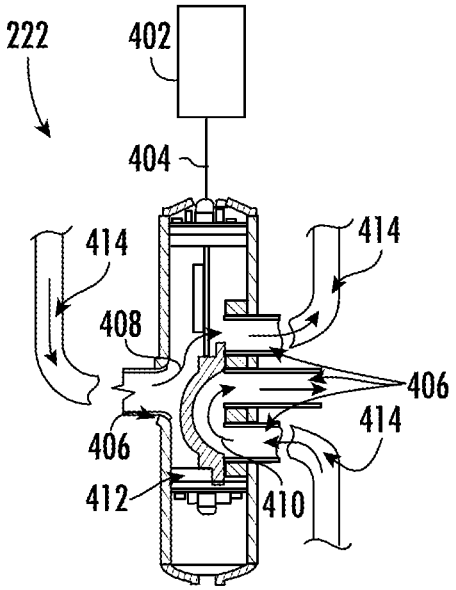
FIG. 4B is another cross-section illustration of a switch over valve, according to an example embodiment of the present disclosure.

In some embodiments, the switch over valve 122 may generally comprise a four-way reversing valve. The switch over valve 122 may also comprise an electrical solenoid, relay, and/or other device configured to selectively move a component of the switch over valve 122 between operational positions to alter the flow path of refrigerant through the switch over valve 122 and consequently the HVAC system 100. Additionally, the switch over valve 122 may also be selectively controlled by the system controller 106, an outdoor controller 126, and/or the indoor controller 124. FIGS. 4A and 4B show additional exemplary embodiments of a switch over valve that may be used in an HVAC device.

The system controller 106 may generally be configured to selectively communicate with the indoor controller 124 of the indoor unit 102, the outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate with a plurality of temperature sensors associated with components of the indoor unit 102, the outdoor unit 104, and/or the outdoor ambient temperature. Additionally, in some embodiments, the system controller 106 may comprise a temperature sensor and/or may further be configured to control heating and/or cooling of conditioned spaces or zones associated with the HVAC system 100. In other embodiments, the system controller 106 may be configured as a thermostat for controlling the supply of conditioned air to zones associated with the HVAC system 100, and in some embodiments, the thermostat includes a temperature sensor.

The system controller 106 may also generally comprise an input/output (I/O) unit (e.g., a graphical user interface, a touchscreen interface, or the like) for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially related and/or unrelated to operation of the HVAC system 100. In some embodiments, the system controller 106 may not comprise a display and may derive all information from inputs that come from remote sensors and remote configuration tools.

In some embodiments, the system controller 106 may be configured for selective bidirectional communication over a communication bus 128, which may utilize any type of communication network (e.g., a controller area network (CAN) messaging, etc.). In some embodiments, portions of the communication bus 128 may comprise a three-wire connection suitable for communicating messages between the system controller 106 and one or more of the components of the HVAC system 100 configured for interfacing with the communication bus 128. Still further, the system controller 106 may be configured to selectively communicate with components of the HVAC system 100 and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116.

Figure 2:
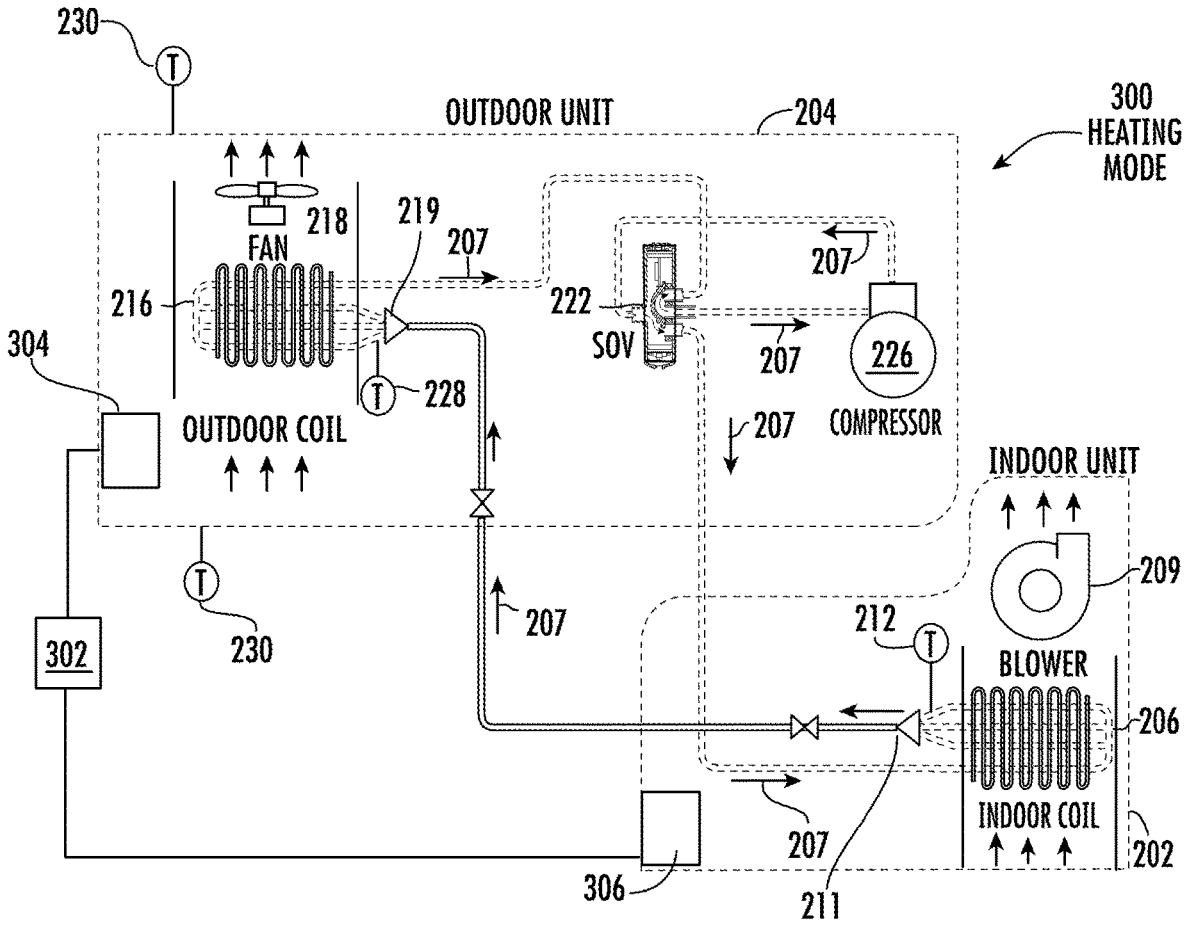
FIG. 2 is a schematic of a heating mode refrigerant cycle of an HVAC system, according to an example embodiment of the present disclosure.
Figure 3:
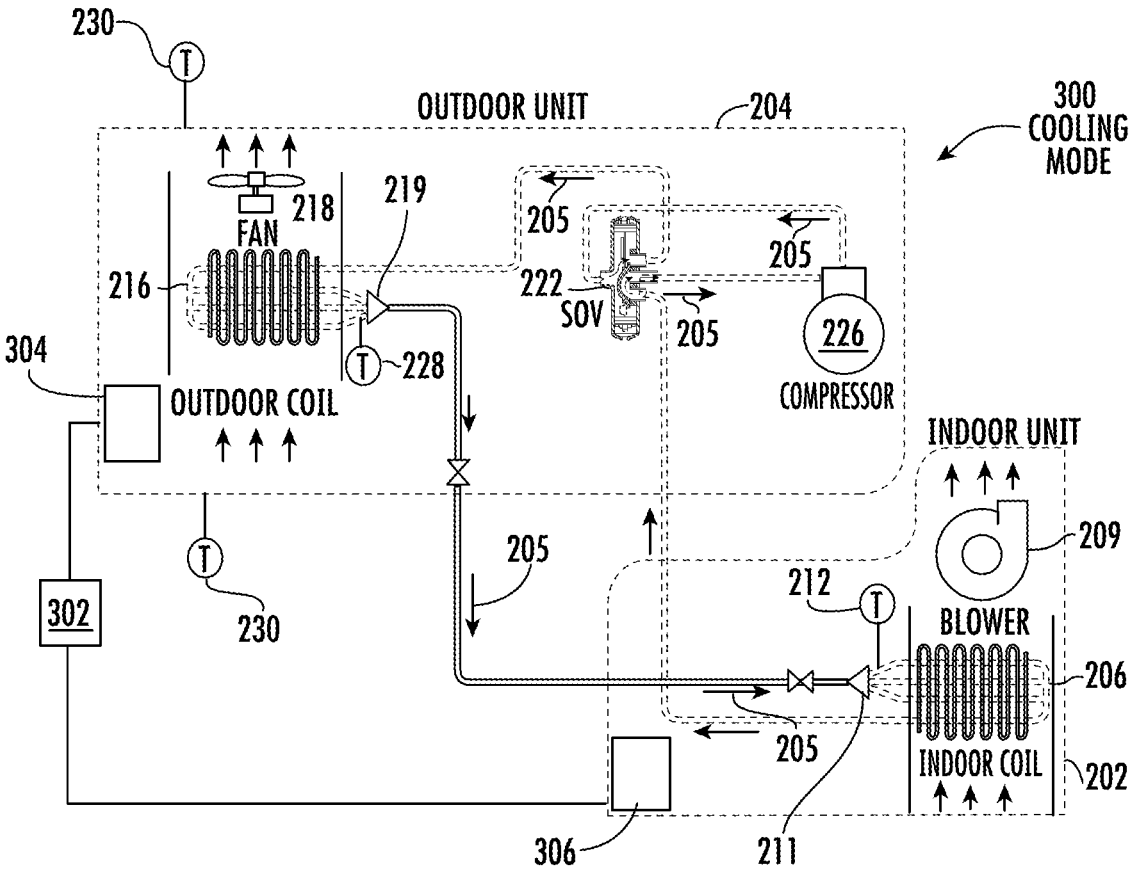
FIG. 3 is a schematic of a cooling mode refrigerant cycle of an HVAC system, according to an example embodiment of the present disclosure.

As discussed above, the HVAC system 100 may operate in at least two operating modes—a heating mode and a cooling mode. FIGS. 2 and 3 provide a more detailed illustration of these components as well as the heating mode cycle (FIG. 2) and the cooling mode cycle (FIG. 3). The embodiment shown in FIGS. 2 and 3 is of a split-system heat pump with an indoor unit and an outdoor unit. The below discussion is also applicable to embodiments that utilized a packaged heat pump where the components associated with the indoor unit and outdoor unit are included within a single unit that may be located inside or outside. As discussed, below the refrigerant fluid may go through various phase changes in these cycles. For example, in some embodiments the refrigerant fluid changes between a liquid, a mixed fluid comprising a liquid and a gas, and a gas. In the embodiments depicted in FIGS. 2 and 3, the refrigerant fluid cycle depicted by solid lines indicates that in that embodiment at that point the refrigerant fluid is either a liquid or a mixed fluid. The refrigerant fluid cycle depicted by dashed lines indicates that in that embodiment at that point in the refrigerant cycle the refrigerant fluid is either a gas or a mixed fluid.

Turning to FIG. 2, an example schematic of a heating mode cycle is shown. In the depicted embodiment, the direction refrigerant fluid travels is indicated by arrows 207. Starting at compressor 226 in FIG. 2, compressor 226 may compress the refrigerant fluid and pump a relatively high temperature and high pressure compressed refrigerant fluid through a switch over valve 222 and to an indoor heat exchanger 206. In some embodiments, the refrigerant fluid is a gas when discharged from compressor 226 in the heating mode cycle. At the heat exchanger 206, the refrigerant fluid may transfer heat to an airflow that is passed through and/or into contact with the indoor heat exchanger 206 by an indoor fan 209. During this process, the refrigerant fluid may undergo a phase change and/or temperature change. In one embodiment, the refrigerant fluid is in a liquid state after passing through the indoor heat exchanger 206 in the heating mode cycle. After exiting the indoor heat exchanger 206, the refrigerant fluid may flow through an indoor metering device 211, such that refrigerant fluid is not substantially restricted by the indoor metering device 211. Some embodiments may include an indoor metering device bi-pass (not shown) that allows the refrigerant fluid to bi-pass the indoor metering device 211. The refrigerant fluid generally exits the indoor metering device 211 and flows to an outdoor metering device 219, which may meter the flow of the refrigerant fluid through the outdoor metering device 219, such that the refrigerant fluid downstream of the outdoor metering device 219 is at a lower pressure than the refrigerant upstream of the outdoor metering device 219. During this process, the refrigerant fluid may undergo a phase change and/or temperature change. In one embodiment, the outdoor metering device 219 changes the state of the refrigerant fluid in the heating circuit to a mixed state that comprises a liquid and gas mixture. In some embodiments, the mixed fluid is predominately a liquid, and in others, the mixed fluid is predominately a gas. From the outdoor metering device 219, the refrigerant may enter an outdoor heat exchanger 216. As the refrigerant fluid is passed through the outdoor heat exchanger 216, heat may be transferred to the refrigerant fluid from an airflow that is passed through and/or into contact with the outdoor heat exchanger 216 by an outdoor fan 218. During this process, the refrigerant fluid may undergo a phase change and/or temperature change. In one embodiment, the refrigerant fluid is in a gas state after passing through the outdoor heat exchanger 216 in the heating mode cycle. The refrigerant fluid leaving the outdoor heat exchanger 216 may flow to a switch over valve 222, where the switch over valve 222 may be selectively configured to divert the refrigerant back to the compressor 226, where the refrigerant cycle may begin again.

Turning to FIG. 3, an example schematic of a cooling mode cycle is shown. In the depicted embodiment, the direction the refrigerant fluid travels in this circuit is indicated by arrows 205. Starting at the compressor 226 in FIG. 3, compressor 226 may compress the refrigerant fluid and pump a relatively high temperature and high pressure compressed refrigerant fluid through the switch over valve 222 and to the outdoor heat exchanger 216. In some embodiments, the refrigerant fluid is a gas when discharged from compressor 226 in the cooling mode cycle. At the heat exchanger 216 the refrigerant fluid may transfer heat to an airflow that is passed through and/or into contact with the outdoor heat exchanger 216 by the outdoor fan 218. During this process, the refrigerant fluid may undergo a phase change and/or temperature change. In one embodiment, the refrigerant fluid is in a liquid state after passing through the outdoor heat exchanger 216. After exiting the outdoor heat exchanger 216, the refrigerant fluid may flow through the outdoor metering device 219, such that refrigerant fluid is not substantially restricted by the outdoor metering device 219. Some embodiments may include an outdoor metering device bi-pass (not shown) that allows the refrigerant fluid to bi-pass the outdoor metering device 219. The refrigerant fluid generally exits the outdoor metering device 219 and flows to the indoor metering device 211, which may meter the flow of the refrigerant fluid through the indoor metering device 211, such that the refrigerant downstream of the indoor metering device 211 is at a lower pressure than the refrigerant upstream of the indoor metering device 211. During this process, the refrigerant fluid may undergo a phase change and/or temperature change. In one embodiment, the indoor metering device 211 changes the state of the refrigerant fluid in the cooling cycle to a mixed state that comprises a liquid and gas mixture. In some embodiments, the mixed fluid is predominately a gas, and in others, the mixed fluid is predominately a liquid. From the indoor metering device 211, the refrigerant may enter the indoor heat exchanger 206. As the refrigerant fluid is passed through the indoor heat exchanger 206, heat may be transferred to the refrigerant fluid from an airflow that is passed through and/or into contact with the indoor heat exchanger 206 by the indoor fan 209. During this process, the refrigerant fluid may undergo a phase change and/or temperature change. In one embodiment, the refrigerant fluid is in a gas state after passing through the indoor heat exchanger 206 in the cooling mode. The refrigerant fluid leaving the indoor heat exchanger 211 may flow to the switch over valve 222, where the switch over valve 222 may be selectively configured to divert the refrigerant back to the compressor 226, where the refrigerant cycle may begin again.

FIGS. 2 and 3 also shows additional components that may be included in embodiments of the present disclosure. For example, the depicted embodiment illustrates a system controller 302, which in some embodiments is the same or similar to the system controller 106 described above. The depicted embodiment further includes an indoor controller 304 and an outdoor controller 306 coupled to the system controller 302, which in some embodiments are the same or a similar to indoor controller 124 and outdoor controller 126 discussed above.

The embodiments depicted in FIGS. 2 and 3 also include various temperature sensors, namely a conditioned air coil temperature sensor 212, an outdoor ambient air coil temperature sensor 228, and one or more ambient air temperature sensors 230 that may be located on the outdoor unit 204. In the depicted embodiments the conditioned air coil temperature sensor 212 is coupled to the refrigerant circuit within the indoor unit 202 proximate the indoor metering device 211, which in the heating mode cycle depicted embodiment (FIG. 2) is upstream of the indoor metering device 211 and downstream of the indoor heat exchanger 206, and in the cooling mode cycle depicted embodiment (FIG. 3) is downstream of the indoor metering device 211 and upstream of the indoor heat exchanger 206. In the depicted embodiments, the outdoor ambient air coil temperature sensor 228 is coupled to the refrigerant circuit within the outdoor unit 204 proximate the outdoor metering device 219, which in the heating mode cycle depicted embodiment (FIG. 2) is downstream of the outdoor metering device 219 and upstream of the outdoor heat exchanger 216, and in the cooling mode cycle depicted embodiment (FIG. 3) is upstream of the indoor metering device 219 and downstream of the outdoor heat exchanger 216. In the depicted embodiments, the outdoor unit 204 includes two outdoor ambient air temperature sensors 230. In some embodiments, these outdoor ambient air temperature sensors 230 are configured to measure the outdoor ambient air temperature flowing into the outdoor unit 204 and the ambient air temperature discharging from the outdoor unit 204. This disclosure, however, contemplates multiple different locations and configurations for these outdoor ambient air temperature sensors. For example, in some embodiments at least one outdoor ambient air temperature sensor may be located a distance from the outdoor air intake or discharge in the outdoor unit, which in some embodiments provides a more accurate indication of the outdoor ambient air temperature.

FIGS. 4A and 4B show a cross-section of an example switch over valve 222 that may be used with this disclosure. In some embodiments, the switch over valve 222 may adjust the refrigerant fluid between a heating mode cycle, potentially the heating mode cycle depicted in FIG. 2, and a cooling mode cycle, potentially the cooling mode cycle depicted in FIG. 3. In the embodiment depicted in FIGS. 4A and 4B, the switch over valve 222 is a four-way reversing valve. In the depicted embodiment, the switch over valve 222 includes an actuator 402, actuator rod 404, valve openings 406, internal channels 408 and 410, and an internal channel chamber 412. In the depicted embodiments, the openings 406 are coupled to the refrigerant cycle via conduits 414, and allow a fluid, e.g., the refrigeration fluid, to flow between the openings 406 through the internal channels 408 and 410. In the depicted embodiments, FIG. 4A corresponds to the heating mode configuration and allows the fluid to follow through the switch over valve 222 in the heating mode cycle as depicted in FIG. 2. FIG. 4B corresponds to the cooling mode configuration and allows the fluid to follow through the switch over valve 222 in the cooling mode cycle depicted in FIG. 3.

In the depicted embodiments, the switch over valve 222 is controlled by the actuator 402 that is connected to the actuator rod 404. The actuator 402 is configured to move the components within the switch over valve 222 via the actuator rod 404. In some embodiments, the actuator 404 moves the internal channel chamber 412, which moves the internal channels 408 and 410 and results in a change in the fluid flow between the opening 406. For example, the actuator 402 may move the internal chamber 412 from the heating mode configuration depicted in FIG. 4A to the cooling mode configuration depicted in FIG. 4B via the actuator rod 404. In the depicted embodiment, this movement also moves the internal chambers 408 and 410, which results in a change in how the various openings 406 are fluidly connected. In the depicted embodiment, this may result in the refrigerant cycle switching between the heating mode cycle (FIG. 2) and the cooling mode cycle (FIG. 3). The disclosed system and method may use any manner of switch over valves, or combination of valves, provided they provide the required functionality.

Figure 5:
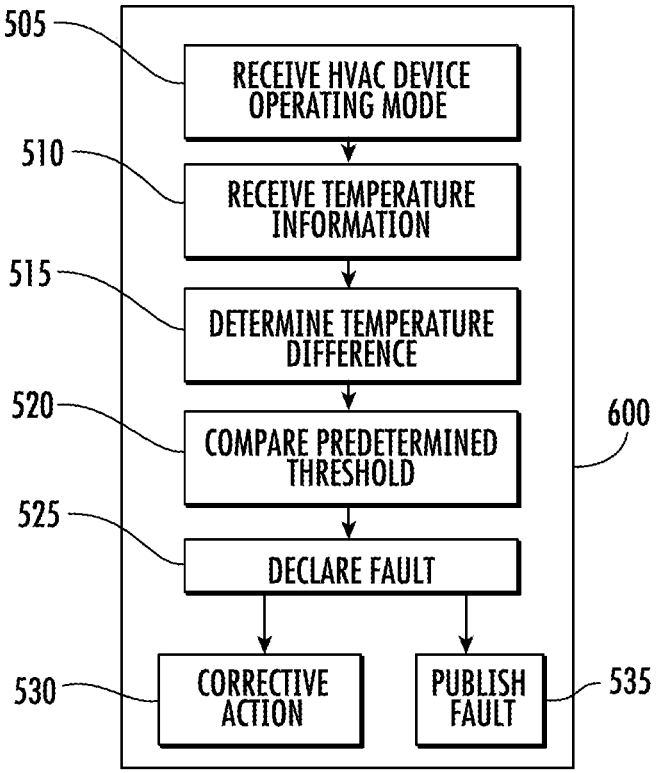
FIG. 5 is a block diagram of a fault detection system, according to an example embodiment of the present disclosure.

FIG. 5 shows a block diagram of how the disclosed system may operate to detect a fault in the heat pump, which in some embodiments includes some or all of the features discussed above. Each of these steps will be discussed in more detail below, however, first an overview is provided. At step 505 of the depicted embodiment, the control circuitry 600 receives an instruction to operate the heat pump in either a heating mode or a cooling mode, potentially via a call for either heating or cooling. At step 510, the control circuitry 600 receives temperature information associated with the refrigerant fluid flowing within the refrigerant cycle and temperature information regarding the outdoor ambient air. In some embodiments, the control circuitry 600 also receives temperature information associated with a conditioned space. At step 515, the control circuitry 600 determines the temperature difference between the ambient air temperature and the refrigerant temperature. At step 520, the control circuitry 600 determines whether the temperature difference between the refrigerant temperature and the ambient air temperature is greater than a predetermined temperature difference threshold. At step 525, the control circuitry 600 declares a fault when the temperature difference is greater than the predetermined temperature difference threshold. At this step of some embodiments, the control circuitry 600 measures the time in which the temperature difference is greater than the predetermined temperature difference threshold. In these embodiments, the control circuitry 600 may declare a fault after a certain period of time has passed. Some embodiments include a step 530 where the control circuitry 600 initiates corrective action in an attempt to fix the fault. Some embodiments include a step 535 where the control circuitry 600 publishes the fault. At this step of some embodiments, the control circuitry sends an alert to publish the fault.

To walk through these steps in more detail, at step 505, the control circuitry 600 may receive an instruction to operate the heat pump in a given operating mode, e.g., a heating call or a cooling call. In some embodiments, the control circuitry 600 also controls the operating mode of the heat pump. In these embodiments, the control circuitry may make the determination to operate the heat pump in a given operating mode and receive the instruction to operate in a given operating mode in the same or related process(es). In some embodiments, a user may select the operating mode for the heat pump, and the control circuitry 600 may receive this instruction via the user input. In some embodiments, the control circuitry 600 may include sensors that receive and determine the operating mode of the heat pump, which may also include providing an instruction to the control circuitry regarding the intended operating mode of the heat pump. For example, in some embodiments, the heat pump may include a thermostat in a conditioned space. In these embodiments, the user may have set a desired temperature set point for the conditioned space. The thermostat may monitor the temperature of the conditioned space via a temperature sensor. The thermostat may direct the heat pump to operate in a heating mode when the temperature measured by the thermostat is under the desired temperature set point for the conditioned space, and it may direct the heat pump to operate in a cooling mode when the temperature measured by the thermostat is above the desired temperature set point. In these embodiments, the control circuitry may receive a call for heating (or cooling) once the thermostat directs the heat pump to operate in a given operating mode.

At step 510, the control circuitry 600 may receive temperature information associated with the heat pump. In some embodiments, the control circuitry 600 receives temperature information associated with the refrigerant fluid circulating within the refrigerant cycle and temperature information associated with the outdoor ambient air. In some embodiments, the control circuitry 600 also receives temperature information associated with a conditioned space. The control circuitry 600 may receive this temperature information in a variety of different ways including temperature sensors, auxiliary systems (e.g., remote database servers, internet), user input, calculation based methods, modeling simulations, or other techniques. In some embodiments, the control circuitry 600 converts the temperature information it receives into temperature inputs that may be used by the control circuitry 600 to perform additional functions. In some embodiments, the temperature inputs comprise the temperature information received either via a signal or otherwise.

In some embodiments where temperature sensors are used, a temperature sensor may be any device configured to measure temperature and provide the control circuitry 600 with a signal indicative of the temperature measured. The temperature signal may be transmitted to the control circuitry 600 and provide information regarding the temperature measured by the temperature sensor. The temperature signal may be any communication signal used to transmit this information. In some embodiments, the temperature signal is an electrical signal comprising a voltage and/or amperage indicative of the temperature measured by the temperature sensor. The control circuitry 600 may utilize other types of temperature signals (e.g., optical signals, wireless communication protocols, etc.). In some embodiments, the temperature signal may be transmitted through multiple devices and multiple forms (e.g., a wireless temperature sensor transmitting a temperature signal to a remote server, etc.). In some embodiments, the control circuitry 600 determines a temperature sensor input, where the temperature sensor input is based in whole or in part on the temperature signal. The temperature sensor input is also indicative of the temperature measured by the temperature sensor, and the control circuitry 600 uses the temperature signal to determine the temperature sensor input.

In some embodiments, the temperature information associated with the refrigerant fluid is provided to and received by the control circuitry 600 via a temperature sensor. In some embodiments, a temperature sensor is coupled to the refrigerant cycle to monitor the temperature of refrigerant fluid. In some embodiments, such as the embodiments depicted in FIGS. 2 and 3, the heat pump 300 includes two temperature sensors coupled to the refrigerant cycle. One temperature sensor 212 is located in the indoor unit, and one temperature sensor 228 is located in the outdoor unit. In some embodiments temperature sensor 212 measures the temperature of the heat exchanger coil of the conditioned air heat exchanger. In some embodiments this temperature sensor 212 measures this temperature in between the indoor metering device 211 and the indoor heat exchanger 206. In some embodiments temperature sensor 228 measures the temperature of the heat exchanger coil of the outdoor ambient air heat exchanger. In some embodiments this temperature sensor 228 measures this temperature in between the outdoor metering device 219 and the outdoor heat exchanger 216. In some embodiments, the control circuitry 600 uses information from temperature sensor 228 to create a refrigerant temperature input used by the control circuitry 600. In some embodiments, the control circuitry 600 receives temperature information from both of these sensors 212 and 228 and uses the temperature information provided by one or both of these sensors to create a refrigerant temperature input.

In some embodiments, the temperature information associated with the outdoor ambient air is provided to and received by control circuitry 600 via a temperature sensor. In some embodiments, the temperature sensor is coupled to the outdoor unit. In the embodiments depicted in FIGS. 2 and 3, the heat pump 300 includes two temperature sensors 230 coupled to the outdoor unit 204. In some embodiments, the control circuitry 600 uses information from these temperature sensors 230 to create an outdoor ambient air temperature input used by the control circuitry 600. In some embodiments, the control circuitry 600 receives temperature information from one of these sensors, and uses the temperature information to create an outdoor ambient air temperature input that is indicative of the outdoor ambient air temperature. In some embodiments, the control circuitry 600 receives temperature information from both of these temperature sensors 230, and uses the temperature information provided from one or both of these sensors to create an ambient air temperature input. In some embodiments, the temperature sensors are located on other portions of the outdoor unit 204 or elsewhere to provide an indication of the outdoor ambient air temperature.

In some embodiments, the temperature information associated with the outdoor ambient air is provided from another source. In some embodiments, the control circuitry 600 receives this information from an auxiliary device, such as a remote server, wireless network, the Internet, or other devices that monitors the outdoor ambient air temperature. In some embodiments, the outdoor ambient air temperature information is determined from a weather service or other similar service. Other methods and devices can be used to determine and provide the outdoor ambient air temperature that is received by the control circuitry 600 to determine the outdoor ambient air temperature input.

In some embodiments, the control circuitry 600 includes and/or is coupled to the thermostat or other temperature sensor that provides an indication of the temperature within the conditioned space. In some embodiments, the control circuitry 600 uses information from the thermostat or other conditioned space temperature sensor to create a conditioned space temperature input used by the control circuitry 600. This disclosure contemplates other methods for receiving and determining the temperature used by the system and method discussed herein.

At step 515, the control circuitry 600 determines the temperature difference between the outdoor ambient air temperature and the refrigerant temperature. In some embodiments, the control circuitry 600 uses the refrigerant temperature information and outdoor ambient air temperature information to determine this difference. In some embodiments, the control circuitry 600 uses the refrigerant temperature input and compares that with the outdoor ambient air temperature input to determine this difference. In some embodiments, the control circuitry 600 uses the absolute value of the difference between refrigerant temperature input and the outdoor ambient air temperature to determine this difference. Other methods for determining this difference are contemplated within the scope of this disclosure.

At step 520, the control circuitry 600 determines whether the temperature difference from step 515 (the refrigerant to outdoor ambient temperature difference) is, depending on the embodiment, one of either greater than, less than, or equal to a predetermined temperature threshold. Some embodiments include a heating mode predetermined threshold, potentially a first threshold value, and a cooling mode predetermined threshold, potentially a second threshold value. In some embodiments, the heating mode predetermined threshold is different than the cooling mode predetermined threshold. In some embodiments the heating mode predetermined threshold is greater than the cooling mode predetermined threshold, and in some embodiments, it is the reverse. In some embodiments, the heating mode predetermined threshold is negative 12° F., and in some embodiments, the system uses the absolute value of the heating mode predetermined threshold, which in some embodiments is 12° F. In some embodiments, the heating mode predetermined threshold is 0° F. In some embodiments, the cooling mode predetermined threshold is 7° F.

The control circuitry 600 may receive the predetermined threshold(s) in a number of different ways. In some embodiments, these predetermined values are provided as part of the system. In some embodiments, the predetermined threshold values are provided as part of a software update. In some embodiments, the predetermined threshold values are inputted by a user. In some embodiments, the predetermined threshold value(s) is changed and/or updated.

At step 525, the control circuit 600 may determine a fault exists. In some embodiments the control circuitry 600 determines a fault exists if the temperature difference determined at step 520 is greater than the predetermined temperature threshold. In other embodiments, the control circuitry 600 may determine a fault exists if the temperature difference from step 515 is less than (and/or equal to) the predetermined temperature threshold. In some embodiments, the control circuitry declares a fault when the temperature difference is greater than the predetermined temperature threshold. The disclosure also contemplates other embodiments where a fault is declared when the temperature difference is equal to or less than the predetermined temperature difference threshold. The fault may be declared in a varied of ways. In some embodiments, the control circuitry declares this fault by generating a signal representative that a fault exists in the system. In some embodiments, the control circuitry takes a given action, and this action is based on (and indicative of) a fault being declared.

In some embodiments, the control circuitry 600 may only declare a fault when the temperature comparison indicates a fault has occurred and other factors corroborate this indication. For example, in some embodiments, the control circuitry 600 includes a timer and only determines a fault has occurred after the temperature difference determined at step 515 is greater than the predetermined temperature difference threshold for a set period of time. In some embodiments, this fault is declared when the temperature difference determined at step 515 is greater than the predetermined temperature difference threshold a certain number of times within a given period of time, or for a certain percentage of a given time period. In some embodiments, the control circuitry 600 only determines a fault has occurred if the temperature difference determined at step 515 is greater than the predetermined temperature difference threshold and the control circuitry 600 determines that the temperature of the conditioned space is deviating from the temperature set point for the conditioned space. For example, in some embodiments, a thermostat may request that heating or cooling is appropriate because the temperature of the conditioned space is below or above the temperature set point for the space, respectively. In an embodiment where a cooling call is received, in normal operation the temperature of the conditioned space would approach the temperature set point. For example, after the cooling mode call was received, in normal operation, the HVAC device would continuously remove heat form the conditioned space, progressively lowing the temperature of conditioned space until the temperature of the conditioned space reached the temperature set point, or was within an acceptable temperature range associate with the temperature set point. Similarly, when a call for heating is received, in normal operation, the HVAC system would add heat to the conditioned space to increase the temperature of the conditioned space until it reached the temperature set point, or was within an acceptable temperature range associate with the temperature set point. In some embodiments of the present disclosure, the control circuitry may monitor this relationship between the temperature set point of a conditioned space and the actual temperature of the conditioned space. If after calling for the HVAC device to operate in the appropriate operating mode for a certain amount of time the temperature of the conditions space moves further away from the temperature set point (as opposed to moving towards the temperature set point), the control circuitry 600 may determine the temperature of the conditioned space is deviating from the temperature set point for the conditioned space.

In some embodiments, the fault declared at step 525 relates to the switch over valve. In these embodiments, the fault declared by the control circuitry may indicate that the switch over valve is not circulating the refrigerant fluid in the appropriate refrigerant cycle. In some embodiments, the fault declared indicates that the switch over valve is circulating the refrigerant fluid in a heating mode refrigerant cycle when the heat pump is intended to be operated in a cooling mode, or that the switch over valve is circulating the refrigerant fluid in a cooling mode refrigerant cycle when the heat pump is intended to be operated in a heating mode. In some embodiments, the fault indicates that the switch over valve is in a heating mode configuration, for example the heating mode configuration shown in FIG. 4A, when a cooling call has been received by the control circuitry 600. In some embodiments, the fault indicates that the switch over valve is in a cooling mode configuration, for example the cooling mode configuration shown in FIG. 4B, when a heating call has been received by the control circuitry 600. The disclosure contemplates other faults that may be declared by the control circuitry at this step.

Some embodiments include a step 530 where the control circuitry 600 takes corrective action once a fault has been declared. In some embodiments, this corrective action is directed to the switch over valve and seeks to ensure that the refrigerant fluid is being circulated in the appropriate cycle based on the intended operation of the heat pump. In some embodiments, the switch over valve is an electronically controlled switch over valve, and the corrective action includes de-energizing the switch over valve and then re-energizing the switch over valve. In some embodiments, the process of de-energizing the switch over valve includes terminating the electrical current to the switch over valve, and the process of re-energizing the switch over valve includes initiating an electrical current to the switch over valve. In some embodiments, the control circuitry 600 may repeat a pattern of de-energizing and re-energizing the switch over valve several times (e.g., up to 10 times or more). Other corrective actions are contemplated within the scope of this disclosure.

Some embodiments include the step 535 where the control circuitry 600 publishes the fault once it has been declared. In some embodiments, this fault is published on a display, which may be included on the indoor controller, outdoor controller, system controller, and/or a thermostat display. In some embodiments, the control circuitry 600 transmits an indication or an alert that a fault has occurred to a remote device, potentially a remote server or other device, that provides an indication a fault has occurred in the system. In these embodiments, the fault may be visually published on a separate device such as a computer, cell phone, tablet, or other device.

Figure 6:
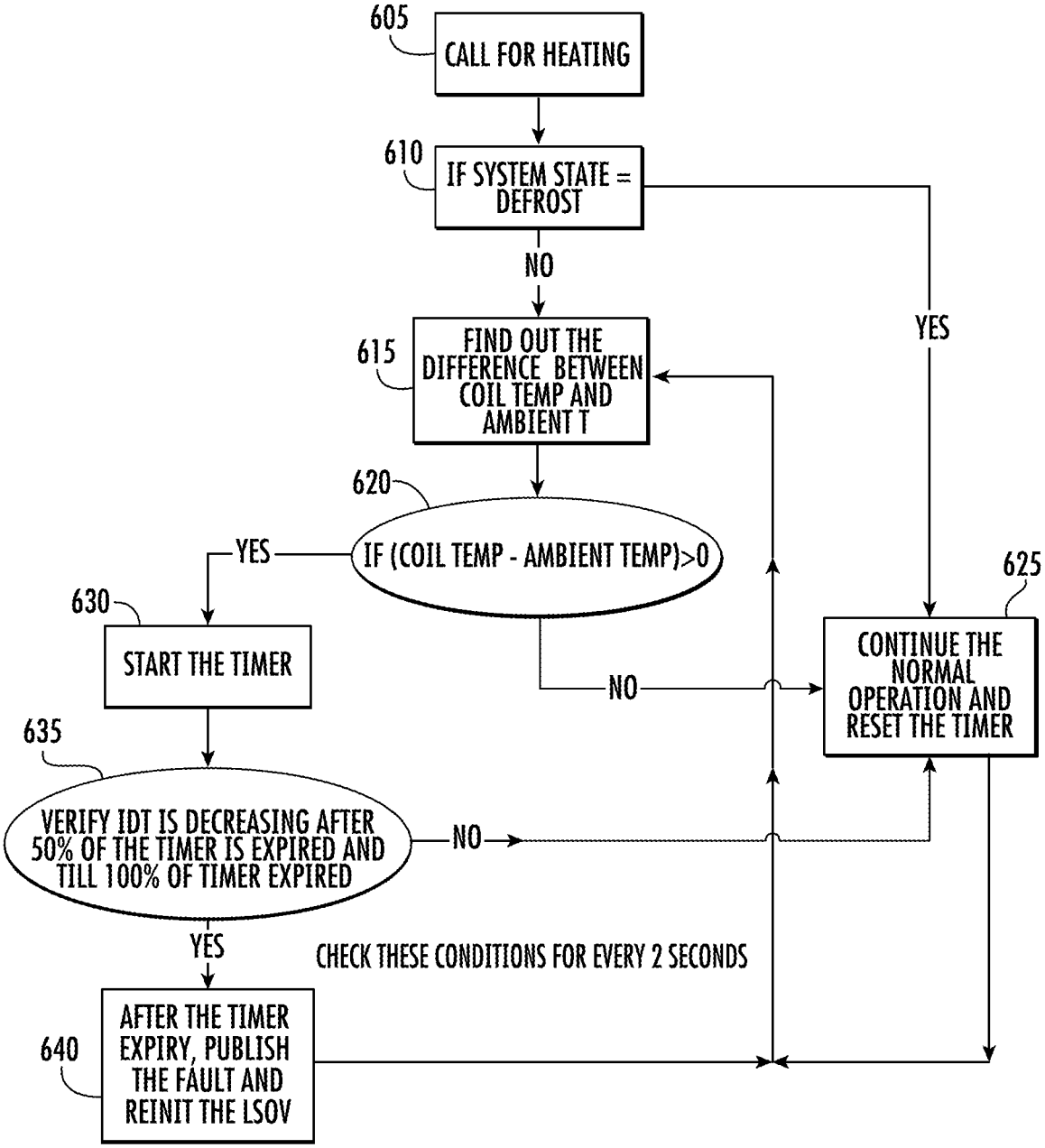
FIG. 6 is a block diagram of a fault detection system when a heating call is received, according to an example embodiment of the present disclosure.

FIG. 6 shows an example embodiment of the present disclosure determining a fault has occurred when the system is intended to be in a heating mode. In this embodiment, at step 605 the control circuitry receives a call heating. At step 610 of the depicted embodiment, the control circuitry determines if other system considerations may impact a difference in temperature between a refrigerant fluid and the outdoor ambient air. In some embodiments, the control circuitry determines if the system is in a defrost mode, potentially because ice is present on the outdoor heat exchanger. If the system is in defrost mode and/or ice is detected, the system may continue its normal operation at step 625. If the system is not in defrost mode and/or no ice is detected, the system may continue to step 615.

At step 615, the control circuitry determines the difference between the refrigerant fluid temperature at the outdoor ambient air heat exchanger coil and outdoor ambient air temperature. In some embodiments, the temperature of the refrigerant fluid is measured with a temperature sensor, and in some embodiments, the temperature sensor is located such that it measures the temperature of the refrigerant fluid prior to entering the outdoor ambient air heat exchanger in a heating mode cycle (e.g., FIG. 2, temperature sensor 228). In the depicted embodiment, the temperature measured by this temperature sensor is indicative of the temperature of the outdoor ambient air heat exchanger coil, which may be referred to in FIG. 6 as "Coil Temp." In some embodiments, the control circuitry also determines the outdoor ambient air temperature using a temperature sensor, potentially one located on the outdoor unit (e.g., FIG. 2, showing temperature sensor 230) or a packaged unit located outside. In some embodiments, the control circuitry converts the temperature measured by the refrigerant temperature sensor 228 into a refrigerant temperature input. In some embodiments, the control circuitry converts the temperature measured by one of the outdoor ambient air temperature sensors 230 into an outdoor ambient air temperature input. In some embodiments, the control circuitry compares the refrigerant temperature input to the outdoor ambient air temperature input to determine the refrigerant to outdoor ambient air temperature difference. In some embodiments, the difference is determined by using the refrigerant temperature subtracted from outdoor ambient air temperature, which in some embodiments may result in a negative number. In some embodiments, the calculation is performed in reverse such that outdoor ambient air temperature is subtracted from the refrigerant temperature, which in some embodiments may result in a negative number. In some embodiments, the control circuitry uses the absolute value of the difference from either of these computations.

At step 620 of the depicted embodiment, the control circuitry compares the temperature difference between the refrigerant temperature input and the outdoor ambient air temperature input to a predetermined temperature difference threshold. In some embodiments, the predetermined temperature difference threshold is 12° F. In some embodiments, potentially where the absolute value of the temperature difference is not used, the predetermined temperature difference threshold is negative 12° F. In the depicted embodiment, the predetermined temperature difference threshold is 0° F., and the temperature difference at step 615 is determined using the refrigerant temperature, which is indicative of the outdoor ambient air heat exchanger coil, and that temperature is subtracted from the outdoor ambient air temperature. If this temperature difference is less than or equal to 0° F. the heat pump continues its normal operation, step 625. If the temperature difference of the refrigerant temperature subtracted from the outdoor ambient air temperature is greater than 0° F., the control circuitry evaluates the system further at step 630.

At step 625 of the depicted embodiment, the heat pump continues in normal operation. In some embodiments, the control circuitry restarts the timer from step 630. In some embodiments, the control circuitry restarts the time when the temperature difference measured at step 615 is below the predetermined temperature threshold by a given amount. In some embodiments, this restart predetermined temperature threshold is different than the predetermined temperature threshold, and in some embodiments, the restart predetermined temperature threshold is less than the predetermined temperature threshold. For example, in the depicted embodiment, the timer is reset when the temperature difference at step 615 (determined in this embodiment by using the refrigerant temperature subtracted from the outdoor ambient air temperature) is less than −1° F. Other embodiments may use different values and calculations methods. In some embodiments, at this step 625 the control circuitry restarts the fault detection process, potentially by initiating step 605, 610, or another step in the process.

At step 630 of the depicted embodiment, the control circuitry measures the time period starting once the temperature difference of the refrigerant temperature subtracted from the outdoor ambient air temperature is greater than the predetermined threshold, which in this embodiment is 0° F. In some embodiments, the control circuitry includes a timer with a pre-determined amount of time that must expire before the system declares a fault has occurred. In some embodiments, the timer starts over if the system determines that the temperature difference of the refrigerant temperature subtracted from the outdoor ambient air temperature is equal to or less than −1° F.

Some embodiments include a step 635 where the control circuitry may also utilize the temperature associated with a conditioned space to determine if the heat pump is operating appropriately. In some embodiments, the control circuitry using a temperature sensor may monitor the temperature of a conditioned space. In some embodiments, the control circuitry may monitor the temperature of the conditioned space relative to a temperature set point. In the depicted embodiment when the system has received a call for heating, the control circuitry may verify that the temperature of the conditioned space is decreasing after a certain amount of time has expired. In the depicted embodiment, the control circuitry preforms this verification after 50% of the time has expired and after 100% of the timer has expired. In some embodiments, if at one or both of these times the control circuitry determines that the temperature is decreasing it may proceed to step 640. If at one or both of these times, the control circuitry determines that the temperature is not decreasing the control circuitry may proceed to step 625 and continue normal operation and/or reset the timer. In some embodiments, this verification may be performed at other points in time, and/or multiple points in time. In some embodiments, the control circuitry proceeds to step 625 only if the system has determined the temperature is not decreasing after two or more verifications have been processed.

At step 640 of the depicted embodiment, the control circuitry declares a fault has occurred after the timer has expired. In some embodiments, the fault indicates that the switch over valve is not circulating the refrigerant fluid in the appropriate cycle based on the operating call received by the control circuitry. In the embodiment depicted in FIG. 6, the fault may indicate that the switch over valve is circulating the refrigerant fluid in a cooling mode cycle when the system has received a heating call. In some embodiments, the control circuitry initiates corrective action by de-energizing and then re-energizing the switch over valve once the fault has been declared. In some embodiments, the control circuitry publishes the fault once the fault has been declared.

Some embodiments also continuously monitor the difference between the refrigerant temperature and outdoor ambient air temperature to determine if a fault is occurring and/or the system is operating appropriately. In these embodiments, the system may return to step 605 and/or 610 after a given amount of time. In some embodiments, the system returns to step 610 at a set period of time, for example, every two seconds. In these embodiments, the system may repeat step 605 and/or 610 after various determinations have been made. In some embodiments, after step 625 has occurred and the system is continuing to operate in normal mode, the system returns to step 605 and/or 610 to repeat the process with updated information. In some embodiments, after the timer has started at step 640, the system returns to step 605 and/or 610 to repeat the process with updated information to determine if the timer should continue. In some embodiments, after a fault has been declared, the system returns to step 605 and/or 610 to determine if the fault has been corrected and/or whether the fault is still present.

Figure 7:
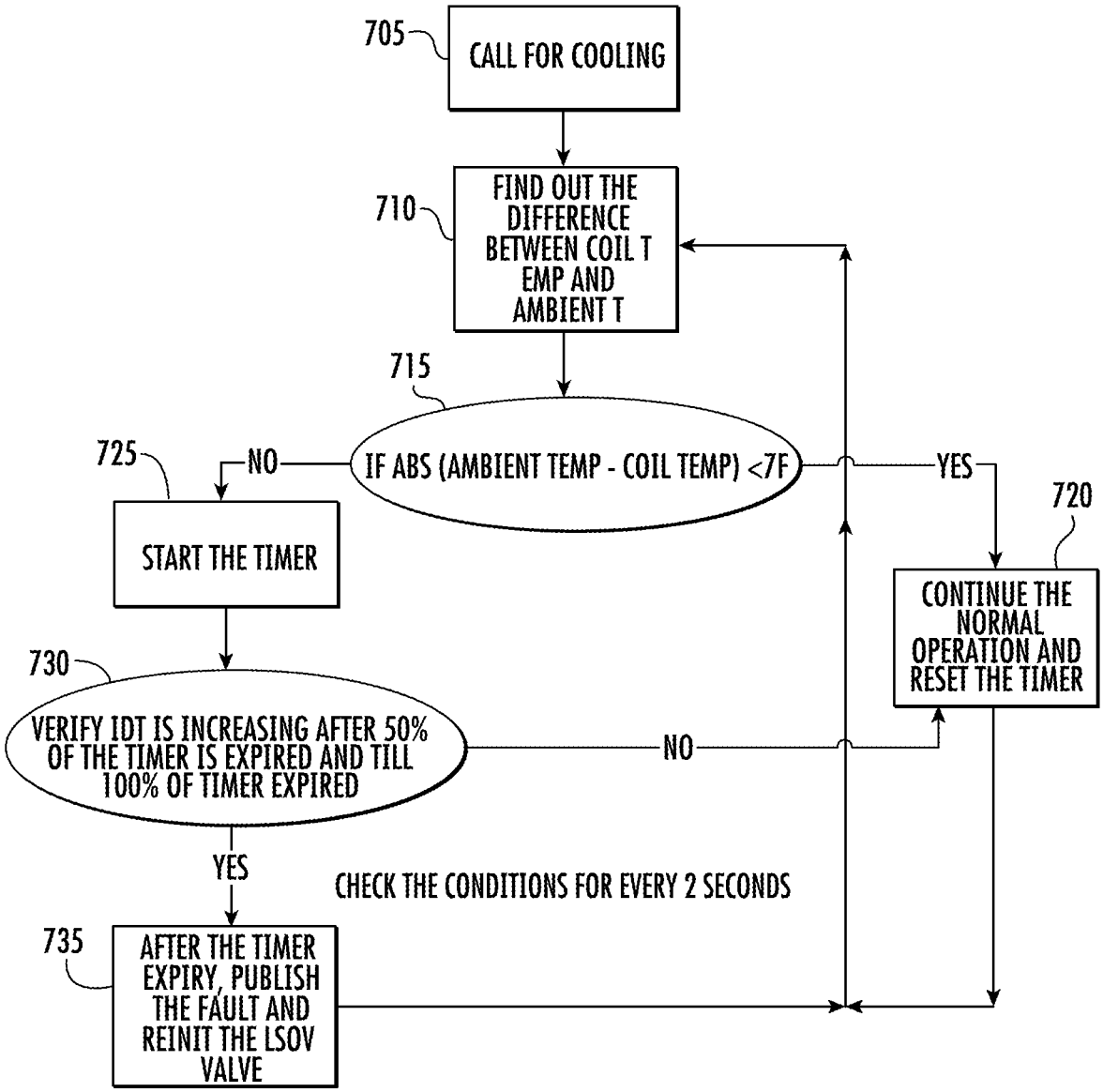
FIG. 7 is a block diagram of a fault detection system when a cooling call is received, according to an example embodiment of the present disclosure.

FIG. 7 shows an example embodiment of the present disclosure determining a fault has occurred when the system is operating in a cooling mode. At step 705 of this embodiment, the control circuitry receives a call for cooling. At step 710, the control circuitry determines the difference between the refrigerant fluid temperature at the outdoor ambient air heat exchanger coil and outdoor ambient air temperature. In some embodiments, the temperature of the refrigerant fluid is measured with a temperature sensor, and in some embodiments, the temperature sensor is located such that it measures the temperature of the refrigerant fluid after being discharged from the outdoor ambient air heat exchanger in a cooling mode cycle (e.g., FIG. 3, temperature sensor 228). In the depicted embodiment, the temperature measured by this temperature sensor is indicative of the temperature of the outdoor ambient air heat exchanger coil, which may be referred to in FIG. 7 as "Coil Temp." In some embodiments, the control circuitry also determines the outdoor ambient air temperature using a temperature sensor, potentially one located on the outdoor unit (e.g., FIG. 3, temperature sensor(s) 230) or a packaged unit located outside. In some embodiments, the control circuitry converts the temperature measured by the refrigerant temperature sensor 228 into a refrigerant temperature input. In some embodiments, the control circuitry converts the temperature measured by one of the outdoor ambient air temperature sensors 230 into an outdoor ambient air temperature input. In some embodiments, the control circuitry compares the refrigerant temperature input to the outdoor ambient air temperature input to determine the refrigerant to outdoor ambient air temperature difference. In some embodiments, this difference is determined by using the refrigerant temperature, potentially the outdoor ambient air coil temperature, subtracted from outdoor ambient air temperature, which in some embodiments may result in a negative number. In some embodiments, the calculation is performed in reverse such that outdoor ambient air temperature is subtracted from the refrigerant temperature, which in some embodiments may result in a negative number. In some embodiments, the control circuitry uses the absolute value of the difference from either of these computations.

At step 715 of the depicted embodiment, the control circuitry compares the refrigerant to outdoor ambient air temperature difference to a predetermined temperature difference threshold. In this embodiment, the predetermined temperature difference threshold is 7° F., and the temperature difference at step 710 is determined using the outdoor ambient air temperature subtracted from the refrigerant temperature, which in this embodiment is indicative of the outdoor ambient air heat exchanger coil temperature. In the depicted embodiment, if the outdoor ambient air temperature subtracted from the refrigerant temperature is less than 7° F., then the heat pump continues its normal operation, step 720. If the outdoor ambient air temperature subtracted from the refrigerant temperature is greater than 7° F., the control circuitry evaluates the system further at step 725.

At step 720 of the depicted embodiment, the heat pump continues in normal operation. In some embodiments, at step 720 the control circuitry restarts the timer from step 725. In some embodiments, the control circuitry restarts the time when the temperature difference measured at step 720 is below the predetermined threshold by a given amount. Other embodiments may use different values and calculations methods. In some embodiments, the control circuitry restarts the fault detection process, potentially by initiating step 710, or another step in the process.

At step 725 of the depicted embodiment, the control circuitry measures the time period starting when the outdoor ambient air temperature subtracted from the refrigerant temperature is greater than 7° F. In some embodiments, the control circuitry includes a timer with a pre-determined amount of time that must expire before the system declares a fault has occurred. In some embodiments, the timer starts over if the system determines that the outdoor ambient air temperature subtracted from the refrigerant temperature is less than 7° F.

Some embodiments include a step 730 where the control circuitry may also utilize the temperature associated with a conditioned space to determine if the heat pump is operating appropriately. In some embodiments, the control circuitry using a temperature sensor may monitor the temperature of a conditioned space. In some embodiments, the control circuitry may monitor the temperature of the conditioned space relative to a temperature set point. In the depicted embodiment when the system has received a call for cooling, the control circuitry may verify that the temperature of the conditioned space is increasing after a certain amount of time has expired. In the depicted embodiment, the control circuitry preforms this verification after 50% of the time has expired and after 100% of the timer has expired. In some embodiments, if at one or both of these times the control circuitry determines that the temperature is increasing it may proceed to step 735. If at one or both of these times, the control circuitry determines that the temperature is not increasing the control circuitry may proceed to step 720 and continue normal operation and/or reset the timer. In some embodiments, this verification may be performed at other points in time, and/or multiple points in time. In some embodiments, the control circuitry proceeds to step 720 only if the system has determined the temperature is not decreasing after two or more verifications have been processed.

At step 735 of the depicted embodiment, the control circuitry declares a fault has occurred after the timer has expired. In some embodiments, the fault indicates that the switch over valve is not circulating the refrigerant fluid in the appropriate cycle based on the operating call received by the control circuitry. In the embodiment depicted in FIG. 7, the fault may indicate that the switch over valve is circulating the refrigerant fluid in a heating mode cycle when the system has received a call to operate the heat pump in a cooling mode. In some embodiments, the control circuitry initiates corrective action by de-energizing and then re-energizing the switch over valve once the fault has been declared. In some embodiments, the control circuitry publishes the fault once the fault has been declared.

Some embodiments also continuously monitor the difference between the refrigerant temperature and outdoor ambient air temperature to determine if a fault is occurring and/or the system is operating appropriately. In these embodiments, the system may return to step 710 after a given amount of time. In some embodiments, the method returns to step 710 after a set period of time, for example, every two seconds. In these embodiments, the system may repeat step 710 after various determinations have been made. For example, in some embodiments, after step 720 has occurred and the system is continuing to operate in normal mode, the system returns to step 710 to repeat the process with updated information. In some embodiments, after the timer has started at step 725, the system returns to step 710 to repeat the process with updated information to determine if the timer should continue. In some embodiments, after a fault has been declared, the system returns to step 710 to determine if the fault has been corrected and/or whether the fault is still present.

Figure 8:
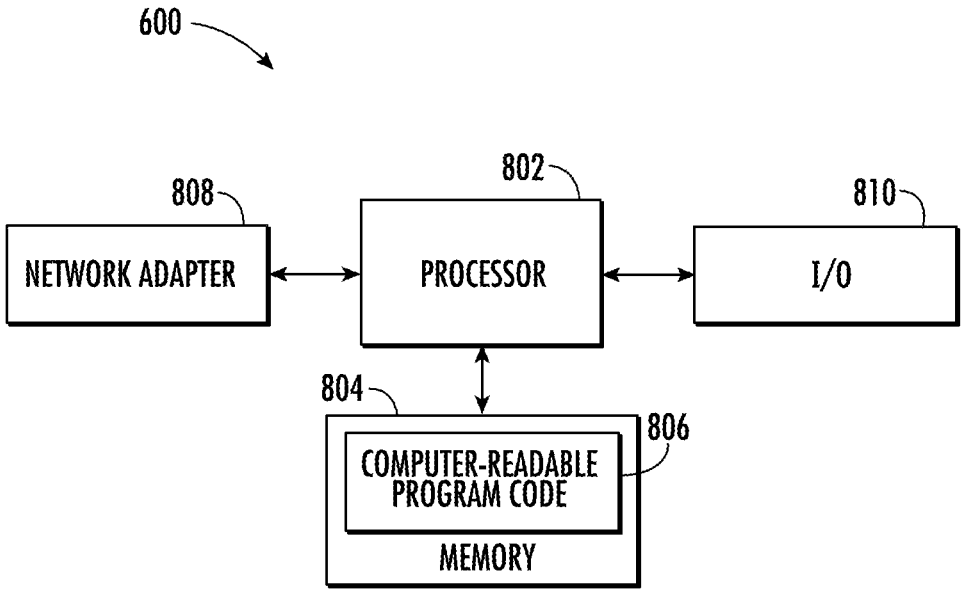
FIG. 8 is an illustration of control circuitry, according to an example embodiment of the present disclosure.

FIG. 8 illustrates the control circuitry 600 according to some example embodiments of the present disclosure. The control circuitry may include one or more of each of a number of components such as, for example, a processor 802 connected to a memory 804. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 802 may be a number of processors, a multi-core processor or some other type of processor, depending on the particular embodiment.

The processor 802 may be configured to execute computer programs such as computer-readable program code 806, which may be stored onboard the processor or otherwise stored in the memory 804. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 804 is generally any piece of computer hardware capable of storing information such as, for example, data, computer-readable program code 806 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 802, causes the control circuitry 600 to perform various operations as described herein, some of which may in turn cause the HVAC system to perform various operations.

In addition to the memory 804, the processor 802 may also be connected to one or more peripherals such as a network adapter 808, one or more input/output (I/O) devices 810 or the like. The network adapter is a hardware component configured to connect the control circuitry 810 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

In some embodiments, the control circuitry may be included within some or all of the following component discussed above, e.g., the system controller, the outdoor unit controller, and/or the indoor unit controller. In some embodiments, the control circuitry includes a CAN messaging network. In some embodiments, the CAN messaging network is included within the system controller, and in some embodiments, the system controller includes the control circuitry for detecting a fault when the system is operating in a heating mode and detecting a fault when the system is operating in a cooling mode. In some embodiments, the temperature information and/or the temperature inputs are represented as CAN messages and processed according the disclosed system and method within the CAN messaging network.

In some embodiments, the control circuitry for determining a fault when the system is operating in a cooling mode is located in the outdoor controller. In some of these embodiments, the control circuitry for determining a fault when the system is operating in a heating mode is located in the indoor controller. In some of these embodiments, the control circuitry may publish a fault once detected on a display, which may be included on a thermostat. Other configurations for the control circuitry and communication networks are contemplated within the scope of the present disclosure.

Many modifications and other embodiments of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments disclosed and that modifications and other embodiments are intended to be included within the scope of the appended claims. Moreover, although the foregoing description and the associated figures describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A heat pump comprising:

a compressor, a metering device, a first heat exchanger, and a second heat exchanger;

a refrigerant cycle comprising a refrigerant fluid that circulates between the first heat exchanger and the second heat exchanger;

a temperature sensor configured to provide a signal indicative of a refrigerant temperature associated with the refrigerant fluid proximate the first heat exchanger, wherein the first heat exchanger is configured to promote heat transfer between the refrigerant fluid and an outdoor ambient environment;

a switch over valve coupled to the refrigerant cycle configured to reverse the refrigerant fluid between the first heat exchanger and the second heat exchanger in the refrigerant cycle, wherein the switch over valve comprises a heating mode configuration that directs the refrigerant fluid in a heating mode cycle when the heat pump is operating in a heating mode, and a cooling mode configuration that directs the refrigerant fluid in a cooling mode cycle when the heat pump is operating in a cooling mode; and control circuitry, wherein the control circuitry is configured to:

receive a call to operate the heat pump in the heating mode or the cooling mode;

determine a refrigerant temperature input based on the signal from the temperature sensor;

determine an outdoor ambient air temperature input indicative of an outdoor ambient air temperature;

determine a temperature difference between the outdoor ambient air temperature input and the refrigerant temperature input;

determine whether the temperature difference is greater than a predetermined temperature difference threshold; and declare a switch over valve fault when the temperature difference is greater than the predetermined temperature difference threshold, wherein the predetermined temperature difference threshold has a first value when the heat pump receives the heating mode call and a second value when the heat pump receives the cooling mode call, wherein the first value is less than the second value.

2. The heat pump of claim 1, wherein the switch over valve fault comprises an indication that the switch over valve is in one of either the heating mode configuration when the heat pump receives the cooling mode call or the cooling mode configuration when the heat pump receives the heating mode call.

3. The heat pump of claim 1, wherein the control circuitry is further configured to:

first de-energize the switch over valve in response to declaring the switch over valve fault; and then re-energize the switch over valve.

4. The heat pump of claim 1, wherein the control circuitry is located in a system controller and comprises a controller area network (CAN) communication network.

5. The heat pump of claim 1, further comprising two or more metering devices, wherein a first metering device is located proximate the first heat exchanger and the temperature sensor is located between the first heat exchanger and the first metering device.

6. The heat pump of claim 1, wherein the control circuitry is further configured to:

measure a temperature of a conditioned space; and determine whether the temperature of the conditioned space is deviating from a temperature set point, and wherein the control circuitry configured to declare the switch over valve fault is further configured to declare the switch over valve fault when the temperature difference is greater than the predetermined temperature difference threshold and the temperature of the conditioned space is deviating from the temperature set point.

7. A heat pump comprising:

a compressor, a metering device, a first heat exchanger, and a second heat exchanger;

a refrigerant cycle comprising a refrigerant fluid that circulates between the first heat exchanger and the second heat exchanger;

a temperature sensor configured to provide a signal indicative of a refrigerant temperature associated with the refrigerant fluid proximate the first heat exchanger, wherein the first heat exchanger is configured to promote heat transfer between the refrigerant fluid and an outdoor ambient environment;

a switch over valve coupled to the refrigerant cycle configured to reverse the refrigerant fluid between the first heat exchanger and the second heat exchanger in the refrigerant cycle, wherein the switch over valve comprises a heating mode configuration that directs the refrigerant fluid in a heating mode cycle when the heat pump is operating in a heating mode, and a cooling mode configuration that directs the refrigerant fluid in a cooling mode cycle when the heat pump is operating in a cooling mode; and control circuitry, wherein the control circuitry is configured to:

receive a call to operate the heat pump in the heating mode or the cooling mode;

determine if the heat pump is in a defrost state when the heating mode call is received;

determine a refrigerant temperature input based on the signal from the temperature sensor;

determine an outdoor ambient air temperature input indicative of an outdoor ambient air temperature;

determine a temperature difference between the outdoor ambient air temperature input and the refrigerant temperature input;

determine whether the temperature difference is greater than a predetermined temperature difference threshold; and declare a switch over valve fault when the temperature difference is greater than the predetermined temperature difference threshold and after determining the heat pump is not in a defrost state.

8. The heat pump of claim 7, wherein the switch over valve fault comprises an indication that the switch over valve is in one of either the heating mode configuration when the heat pump receives the cooling mode call or the cooling mode configuration when the heat pump receives the heating mode call.

9. The heat pump of claim 7, wherein the control circuitry is further configured to:

first de-energize the switch over valve in response to declaring the switch over valve fault; and then re-energize the switch over valve.

10. The heat pump of claim 7, wherein the control circuitry is located in a system controller and comprises a controller area network (CAN) communication network.

11. The heat pump of claim 7, further comprising two or more metering devices, wherein a first metering device is located proximate the first heat exchanger and the temperature sensor is located between the first heat exchanger and the first metering device.

12. The heat pump of claim 7, wherein the control circuitry is further configured to:

measure a temperature of a conditioned space; and determine whether the temperature of the conditioned space is deviating from a temperature set point, and wherein the control circuitry configured to declare the switch over valve fault is further configured to declare the switch over valve fault when the temperature difference is greater than the predetermined temperature difference threshold and the temperature of the conditioned space is deviating from the temperature set point.

13. A heat pump comprising:

a compressor, a metering device, a first heat exchanger, and a second heat exchanger;

a refrigerant cycle comprising a refrigerant fluid that circulates between the first heat exchanger and the second heat exchanger;

a temperature sensor configured to provide a signal indicative of a refrigerant temperature associated with the refrigerant fluid of an outdoor unit proximate the first heat exchanger, wherein the first heat exchanger is configured to promote heat transfer between the refrigerant fluid and an outdoor ambient environment;

a switch over valve coupled to the refrigerant cycle configured to reverse the refrigerant fluid between the first heat exchanger and the second heat exchanger in the refrigerant cycle, wherein the switch over valve comprises a heating mode configuration that directs the refrigerant fluid in a heating mode cycle when the heat pump is operating in a heating mode, and a cooling mode configuration that directs the refrigerant fluid in a cooling mode cycle when the heat pump is operating in a cooling mode; and control circuitry, wherein the control circuitry is configured to:

receive a call to operate the heat pump in the heating mode or the cooling mode;

determine a refrigerant temperature input based on the signal from the temperature sensor;

determine an outdoor ambient air temperature input indicative of an outdoor ambient air temperature;

determine a temperature difference between the outdoor ambient air temperature input and the refrigerant temperature input;

determine whether the temperature difference is greater than a predetermined temperature difference threshold;

measure a time period that starts when the temperature difference is determined to be greater than the predetermined temperature difference threshold;

restart the time period if the temperature difference is determined to be less than a restart predetermined temperature difference threshold, wherein the restart predetermined temperature difference threshold is less than the predetermined temperature difference threshold; and declare a switch over valve fault when the temperature difference is greater than the predetermined temperature difference threshold and after the measured time period exceeds a predetermined time period.

14. The heat pump of claim 13, wherein the switch over valve fault comprises an indication that the switch over valve is in one of either the heating mode configuration when the heat pump receives the cooling mode call or the cooling mode configuration when the heat pump receives the heating mode call.

15. The heat pump of claim 13, wherein the control circuitry is further configured to:

first de-energize the switch over valve in response to declaring the switch over valve fault; and then re-energize the switch over valve.

16. The heat pump of claim 13, wherein the control circuitry is located in a system controller and comprises a controller area network (CAN) communication network.

17. The heat pump of claim 13, further comprising two or more metering devices, wherein a first metering device is located proximate the first heat exchanger and the temperature sensor is located between the first heat exchanger and the first metering device.

18. The heat pump of claim 13, wherein the control circuitry is further configured to:

measure a temperature of a conditioned space; and determine whether the temperature of the conditioned space is deviating from a temperature set point, and wherein the control circuitry configured to declare the switch over valve fault is further configured to declare the switch over valve fault when the temperature difference is greater than the predetermined temperature difference threshold and the temperature of the conditioned space is deviating from the temperature set point.

* * * * *